US011415298B1

(12) United States Patent
Rodvold

(10) Patent No.: US 11,415,298 B1
(45) Date of Patent: Aug. 16, 2022

(54) LIGHT FIXTURE

(71) Applicant: Covert Kinetic Lighting, Inc., Dallas, TX (US)

(72) Inventor: Chad Rodvold, Dallas, TX (US)

(73) Assignee: Covert Kinetic Lighting, Inc., Dallas, TX (US)

( * ) Notice: Subject to any disclaimer, the term of this patent is extended or adjusted under 35 U.S.C. 154(b) by 0 days.

(21) Appl. No.: 17/190,710

(22) Filed: Mar. 3, 2021

(51) Int. Cl.

| | |
|---|---|
| ***F21V 21/02*** | (2006.01) |
| ***F21V 17/10*** | (2006.01) |
| ***F21S 8/00*** | (2006.01) |
| ***F21V 23/04*** | (2006.01) |
| ***F21V 23/00*** | (2015.01) |

(52) U.S. Cl.
CPC ..... *F21V 21/02* (2013.01); *F21S 8/03* (2013.01); *F21V 17/107* (2013.01); *F21V 23/002* (2013.01); *F21V 23/0471* (2013.01)

(58) Field of Classification Search
CPC ..... F21S 8/03; F21V 17/007; F21V 17/107; F21V 21/02; F21V 23/002; F21V 23/0471; F21W 2111/027; F21W 2131/10; F21W 2131/107; F21W 2131/109
See application file for complete search history.

(56) References Cited

U.S. PATENT DOCUMENTS

| | | | | |
|---|---|---|---|---|
| 3,692,993 | A * | 9/1972 | Robinson | F21V 21/30 362/249.07 |
| 5,124,902 | A * | 6/1992 | Puglisi | F21S 8/028 362/153.1 |
| 5,510,966 | A * | 4/1996 | Konecny | F21S 8/028 362/145 |
| 6,467,911 | B1 * | 10/2002 | Ueyama | F21V 17/00 348/E5.137 |
| 6,578,233 | B1 * | 6/2003 | Avila | F21V 17/107 16/344 |
| 6,918,680 | B2 * | 7/2005 | Seeberger | F21S 8/028 362/427 |
| 8,002,433 | B1 * | 8/2011 | Cucksey | F21S 4/10 362/249.02 |
| 9,777,898 | B1 * | 10/2017 | Landry | F21V 23/002 |
| 10,634,326 | B2 * | 4/2020 | Kasmeier | F21S 8/032 |
| 2004/0105255 | A1 * | 6/2004 | Seeburger | F21S 8/028 362/145 |
| 2006/0133096 | A1 * | 6/2006 | Corbett | F21S 8/028 362/372 |
| 2009/0080204 | A1 * | 3/2009 | Puglisi | F21S 8/024 362/371 |
| 2010/0328932 | A1 * | 12/2010 | Fogerlie | F21S 8/086 362/183 |

* cited by examiner

*Primary Examiner* — Zheng Song
(74) *Attorney, Agent, or Firm* — Barnes & Thornburg LLP; Jerry C. Harris, Jr.

(57) ABSTRACT

A light fixture includes a housing adapted to secure the light fixture to a building. A lamp may be mounted to the housing. The light fixture further includes an actuator configured to move the device to move between a retracted position and an extended position so that the lamp can illuminate an area around the building.

20 Claims, 9 Drawing Sheets

LIGHT FIXTURE

BACKGROUND

The present disclosure relates to a fixture, and particularly to a fixture that is configured to mount one or more devices to a building. More particularly, the present disclosure relates to a fixture that is configured to hide and expose the one or more devices.

SUMMARY

According to the present disclosure, light fixture includes a light fixture housing adapted to secure the light fixture to a building and defining an interior space. The light fixture housing includes an enclosure and a door coupled to the enclosure for movement between a closed position obstructing view into the interior space and an opened position allowing view of the interior space.

In illustrative embodiments, the light fixture further includes an actuator having a first end coupled to the enclosure and a second end spaced apart from the first end and coupled to the door. The actuator is configured to move the door between the closed position and the opened position. In illustrative embodiments, the light fixture further includes a lamp coupled to the door for movement therewith between the closed position, in which the lamp is located within the interior space of the light fixture housing, and the opened position, in which the lamp is located outside of the interior space.

In illustrative embodiments, the enclosure includes a top panel, a front panel, a back panel, a first side panel, and a second side panel. In illustrative embodiments, the door contacts the first side panel, the second side panel, and the front panel when the door is in the closed position and is spaced apart from the first side panel, the second side panel, and the front panel when the door is in the opened position. In illustrative embodiments, the enclosure further includes a bottom panel and the door is coupled to the bottom panel to provide the door pivot axis between the door and the bottom panel. In illustrative embodiments, the enclosure further includes a corner panel coupled to the top panel and the front panel, and the corner panel is arranged to lie along a plane different than both the top panel and the front panel.

In illustrative embodiments, the door is mounted to the enclosure for pivotable movement about a door pivot axis between the closed position and the opened position. In illustrative embodiments, the door pivot axis is spaced apart from the back panel. In illustrative embodiments, in the closed position, electrical wires of the lamp are located above the bottom panel.

In illustrative embodiments, the enclosure is formed to include a slot, and wherein the enclosure is coupled to the building using a fastener that extends through the slot and the fastener is movable through the slot to adjust a position of the enclosure relative to the building.

In illustrative embodiments, the door includes a door panel and a lamp mount flange coupled to the door panel. In illustrative embodiments, the lamp mount flange is arranged to lie at an angle relative to the door panel and the lamp is mounted to the lamp mount flange.

In illustrative embodiments, the light fixture further includes a control system configured to receive user inputs to actuate the actuator to move the door between the closed position and the opened position. In illustrative embodiments, the control system is configured to automatically change the door from the closed position to the opened position in response to a signal from an alarm system of the building.

According to another aspect of the present disclosure, a light fixture includes a light fixture housing, a lamp, and an actuator. The light fixture housing is adapted to secure the light fixture to a building and defining an interior space. The lamp is configured to move between a hidden position and an exposed position. The actuator is coupled to the light fixture housing and the lamp and configured to move the lamp between the hidden position, in which the lamp is obstructed from view from an area, and the exposed position, in which the lamp is visible from the area and is configured to illuminate the area.

In illustrative embodiments, the actuator is arranged to lie in the interior space of the light fixture housing when the lamp is in the hidden position. In illustrative embodiments, the light fixture housing includes an enclosure that defines the interior space and an actuator mount arranged to lie within the interior space and configured to position the actuator above a lowermost edge of the enclosure.

In illustrative embodiments, the actuator mount includes a support panel coupled to the actuator, and a hollow crossbeam coupled to the support panel below the actuator. Electrical wires of the lamp extend through the hollow crossbeam to guide the electrical wires as the lamp changes between the hidden position and the exposed position.

According to another aspect of the present disclosure, a method includes steps of, mounting a light fixture to a building, and adjusting a position of the light fixture relative to the building so that a lamp of the light fixture is hidden from view.

In illustrative embodiments, the light fixture further includes a door and wherein the step of mounting includes mounting the light fixture to a support structure in an eave of the building. In illustrative embodiments, the step of adjusting includes sliding the light fixture relative to the support structure so that the light fixture extends through an opening in an exterior wall of the building and the door is flush with the exterior wall of the building.

In illustrative embodiments, the light fixture further includes an enclosure and the method further includes a step of shaping the enclosure so that at least one panel of the enclosure matches an angle of inclination of a roof of the building. In illustrative embodiments, the enclosure is positioned relative to the roof such that the at least one panel is arranged in face-to-face relation with an inside surface of the roof.

Additional features of the present disclosure will become apparent to those skilled in the art upon consideration of illustrative embodiments exemplifying the best mode of carrying out the disclosure as presently perceived.

BRIEF DESCRIPTIONS OF THE DRAWINGS

The detailed description particularly refers to the accompanying figures in which.

DETAILED DESCRIPTION

Figure 1:
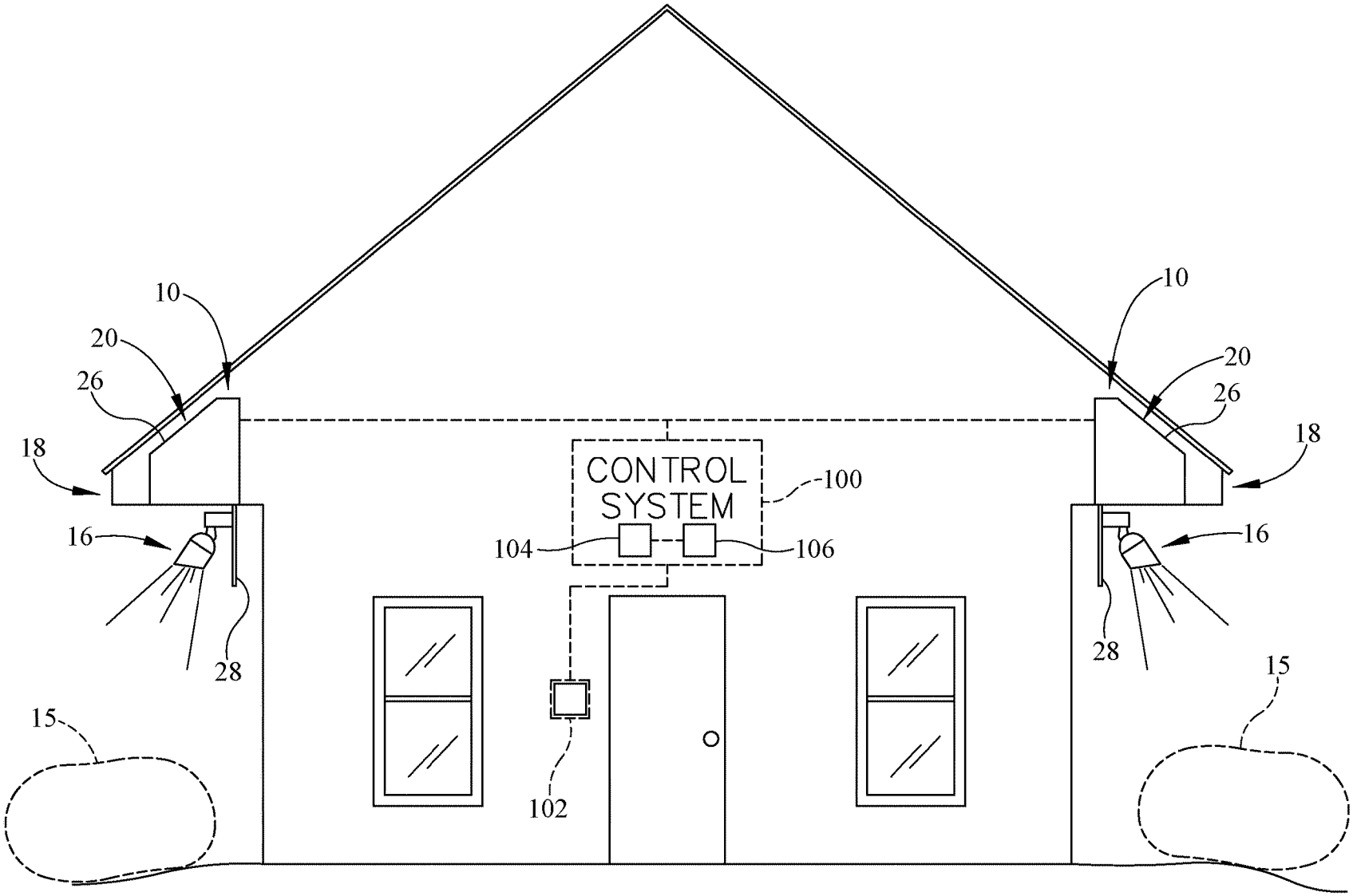
FIG. 1 is a front elevation view of a building with portions removed to show a plurality of light fixtures each having a retractable lamp.

A light fixture 10 in accordance with the present disclosure is shown in FIG. 1. The light fixture 10 is coupled to a building 12 that illustratively includes a plurality of light fixtures 10 positioned on different parts of the building 12 to provide exterior lighting around the building 12. Each of the light fixtures 10 is coupled to a central control system 100 and includes a retractable lamp 16 (or device 16) that may be controlled by user inputs into the control system 100 to move the lamp 16 between a retracted configuration as shown in FIG. 2 and an extended configuration as shown in FIG. 3.

Figure 2:
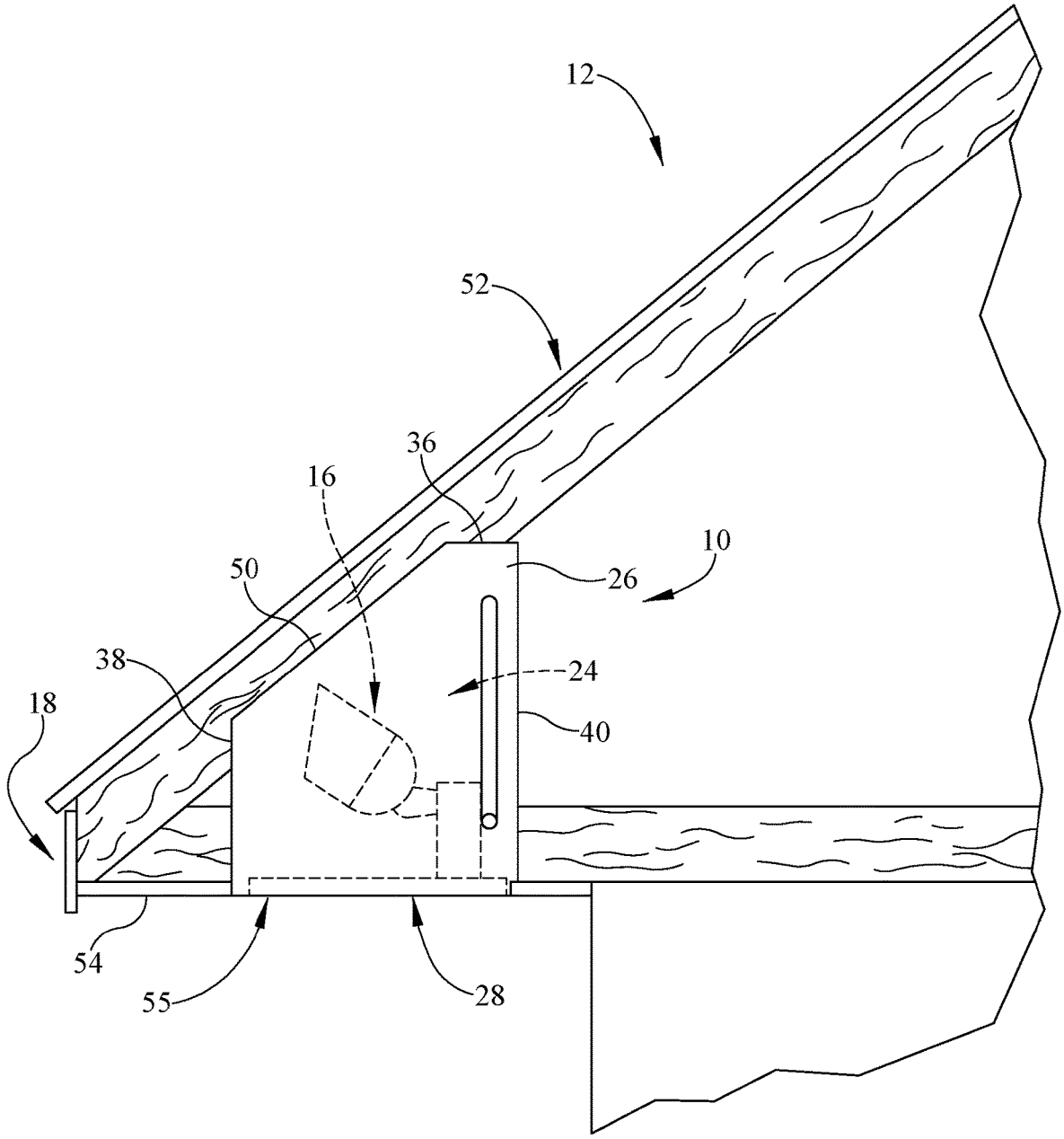
FIG. 2 is an elevation view of a portion of the building from FIG. 1 showing one of the light fixtures in a retracted configuration in which the lamp is hidden from view.
Figure 3:
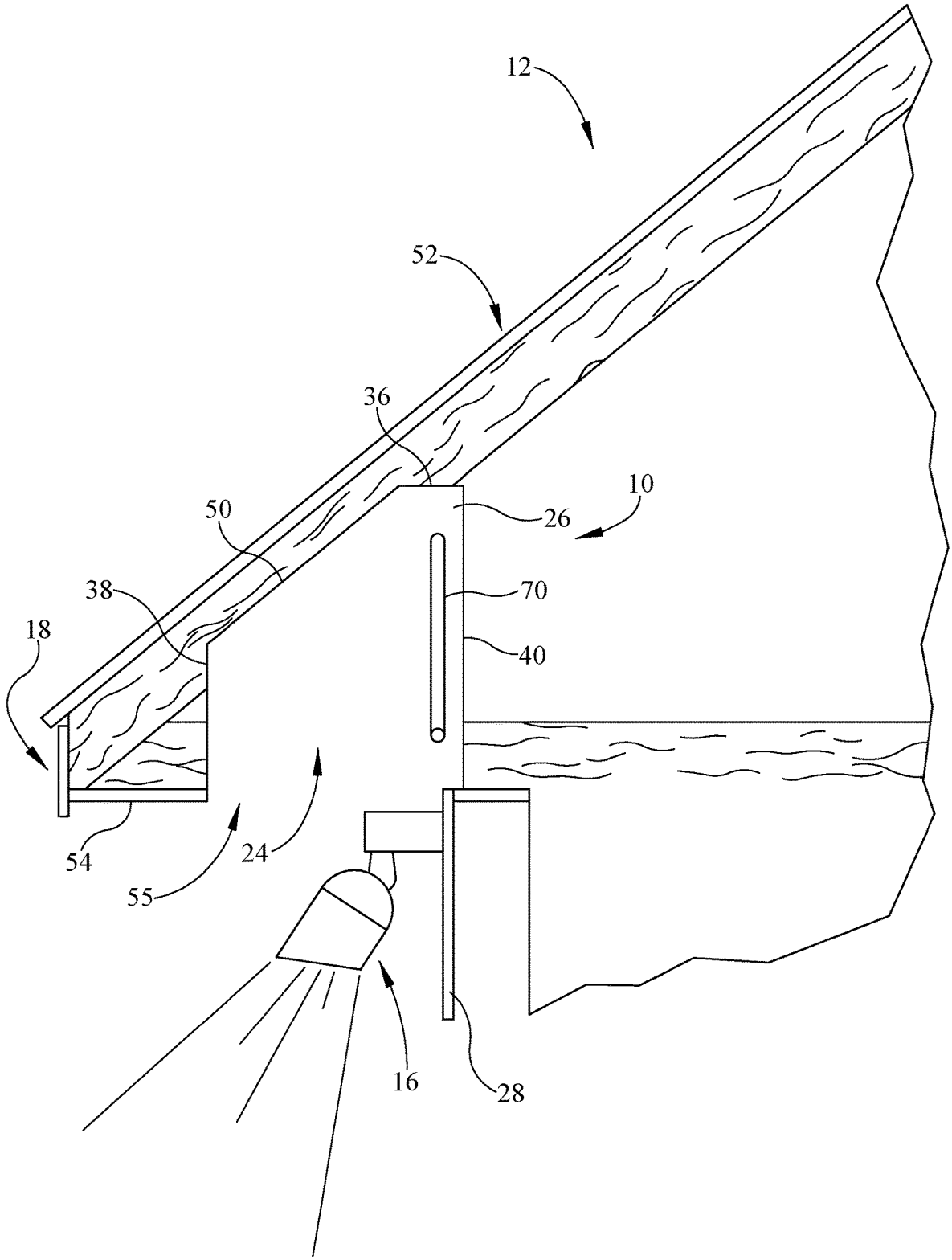
FIG. 3 is an elevation view similar to FIG. 2 showing the light fixture in an extended configuration in which the lamp is exposed to illuminate an area around the building.

Each light fixture 10 is arranged to lie within a portion of the building 12, such as an eave 18 or an attic of the building, as shown in FIGS. 1-3. Each light fixture 10 includes an enclosure 20, an actuator 22, and a retractable lamp 16 that is configured to be moved by the actuator 22 between the retracted configuration and the extended configuration. The enclosure 20 defines an interior space 24 that houses the actuator 22 and the lamp 16 in the retracted configuration. The actuator 22 is configured to move in response to a user input to cause the lamp 16 move from inside the interior space 24 in the retracted configuration to outside the interior space 24 in the extended configuration. The lamp 16 is hidden from view from an area 15 around the building 12 in the retracted configuration and is configured to illuminate the area 15 around the building 12 in the extended configuration.

The control system 100 is configured to control extension and retraction of the lamp 16 in response to signals from a device 102 as shown in FIG. 1. The control system 100 includes a microprocessor 104 and a memory storage device 106 storing instructions that, when executed by the microprocessor 104, cause the microprocessor to send one or more command signals to the actuator 22 to extend or retract the lamp 16. The control system 100 may be included in the light fixture 10 or located in a remote location relative to the light fixture 10. The control system 100 may be communicatively coupled to the light fixture 10 with a wired or wireless connection. If a wireless connection is included, the control system 100 can include one or more antennas and transceivers to send and receive signals.

The device 102 is used to communicate with the control system 100 and may include a user's mobile device, such as a smart phone, tablet, laptop, etc., an alarm system, a digital voice assistant, or any other type of device that can communicate with the control system 100. The user may enter commands (i.e. via user inputs or voice inputs) into the device 102 to command the control system 100 to extend or retract the lamp or device 16 when desired.

In some embodiments, the control system 100 may be configured to automatically extend the lamp 16 after a predetermined event occurs. In one example, the control system 100 automatically extends the lamp 16 to illuminate the area 15 upon activation of an alarm system of the building 12. In another example, the control system 100 automatically extends the lamp 16 to illuminate the area 15 upon receipt of a signal from a motion sensor coupled to the light fixture 10 sensing motion in the area 15. In another example, the control system 100 automatically extends the lamp 16 to illuminate the area 15 after a light switch (not shown) coupled to the light fixture 10 is flipped such that electricity flows through the light fixture 10. In yet another example, the control system 100 may include a timer and the control system 10 0 may be scheduled to automatically extend and retract at a set time of the day (i.e. dusk to dawn).

The enclosure 20 protects the actuator 22 and the lamp 16 and is configured to be mounted to a structure 13 of the building 12, such as a joist or a rafter, to position the lamp 16 relative to the building 12 as shown in FIGS. 2 and 3. The enclosure 20 includes a housing 26 and a door 28 coupled to the housing 26. When the light fixture 10 is in the retracted configuration, the lamp 16 is located within the interior space 24 and the housing 26 and the door 28 cooperate to define the interior space 24. When the light fixture 10 is in the extended configuration, the door 28 is at least partially spaced from the housing 26, and the interior space 24 is open so that the lamp 16 can illuminate the area 15 around the building 12. The lamp 16 is mounted to the door 28 to move therewith as the light fixture 10 changes between the retracted configuration and the extended configuration. The door 28 is coupled to the housing 26 for pivotable movement about a door-pivot axis 28A to change the light fixture 10 between the retracted configuration and the extended configuration. The lamp 16 may be movable relative to the enclosure 20 to adjust the illuminated area 15.

Figure 5:
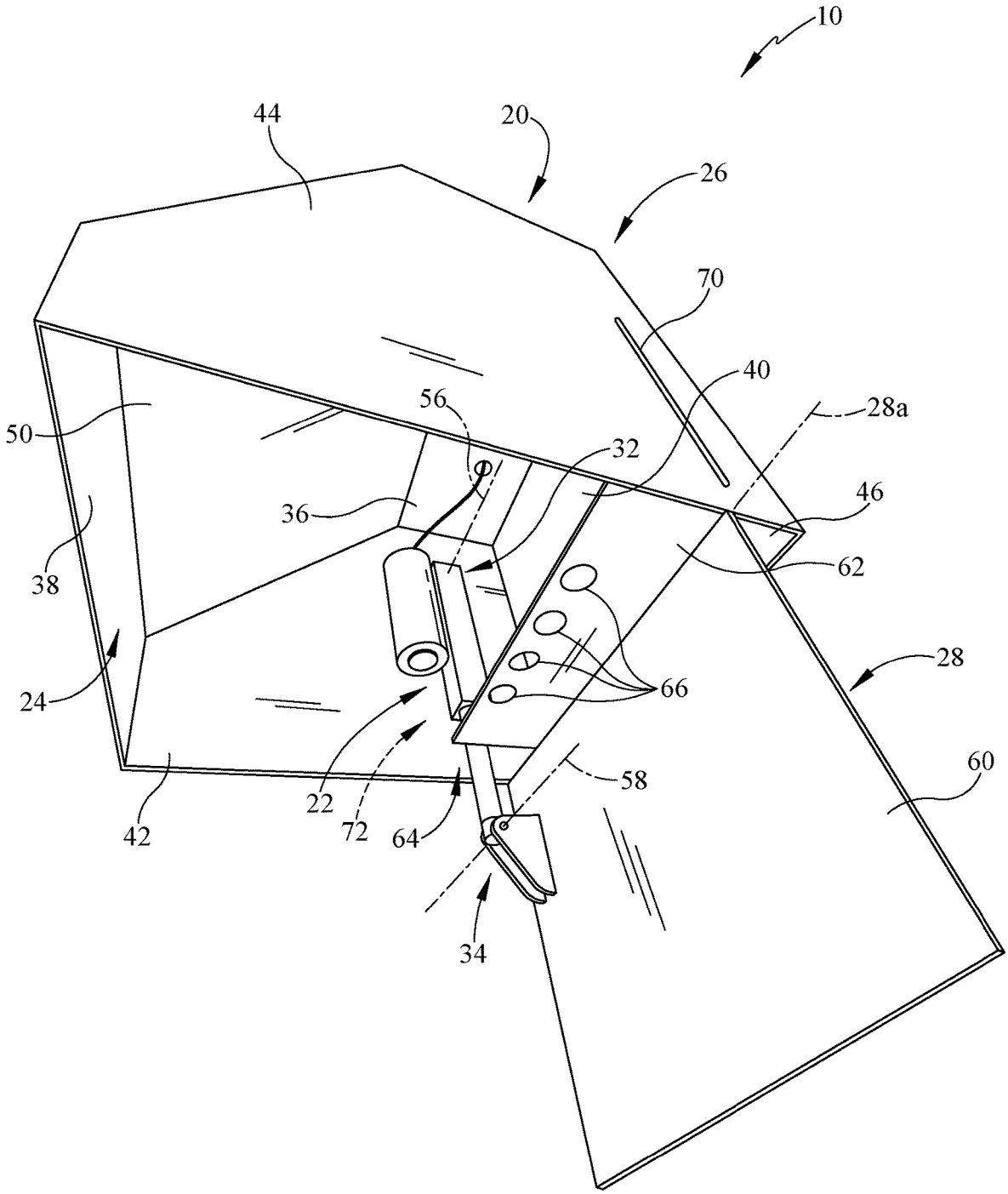
FIG. 5 is a perspective view of the light fixture of FIG. 1 showing that the light fixture further includes an enclosure that contains the lamp in the retracted configuration and an actuator configured to change the light fixture from the retracted configuration to the extended configuration.

The actuator 22 is a linear actuator and is configured to pivot the door 28 and the lamp 16 about the door-pivot axis 28A relative to the housing 26 between a closed position and an opened position as shown in FIGS. 2, 3, and 5. The actuator 22 includes a first end 32 coupled to the housing 26 and an opposite, second end 34 coupled to the door 28. In some embodiments, the housing 26 may be omitted and the first end 32 of the actuator 22 may be coupled to another fixed structure, such as a joist or rafter in the eave 18 or attic, for example. The actuator 22 is mounted to the enclosure 20 for pivotable movement about a first pivot axis 56 at the first end 32 and is mounted to the door 28 for pivotable movement about a second pivot axis 58 at the second end 34. The actuator 22 pivots about both the first pivot axis 56 and the second pivot axis 58 as the door moves between the closed and opened positions.

The actuator 22 and the lamp 16 are housed and protected by the enclosure 20 as shown in FIG. 5. The lamp 16 is an outdoor flood light in the illustrative embodiment. In some embodiments, another device such as a security camera may be used in place of or in addition to the lamp 16. It should be appreciated that the light fixture 10 may also be used in an interior setting with an indoor lamp 16.

Figure 4:
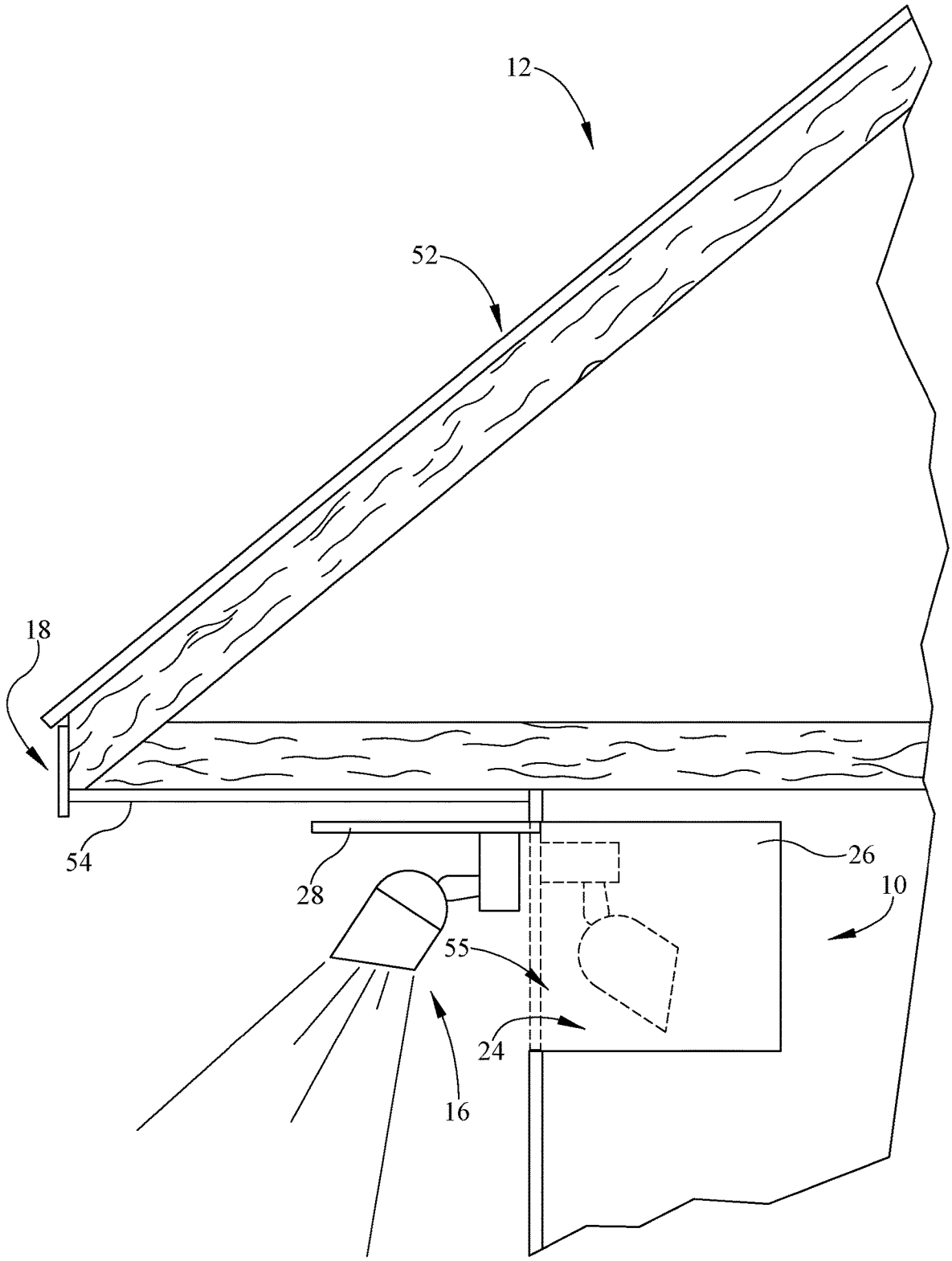
FIG. 4 is an elevation view of the light fixture arranged in a vertical wall of a building.

The light fixture 10 is positioned within an eave 18 so that the door 28 depends from the eave 18 and lies in face-to-face relation with an exterior wall of the building 12 in the extended configuration as shown in FIGS. 1 and 3. In other embodiments, the light fixture 10 may be positioned in a different location relative to the building 12 such that the door 28 pivots upwardly to lie in face-to-face relation with a soffit of the eave 18 in the extended configuration as shown in FIG. 4.

The enclosure 20 may be shaped to fit within a particular area or of the building 12 or to match a feature of the building 12 so that the light fixture 10 is out of sight when not being used. Illustratively, the enclosure 20 is formed in the shape of a polyhedron prism. The enclosure 20 can include any suitable number of sides or panels. Each of the panels forming the prism may be sized and/or shaped equally or unequally relative to one another.

The housing 26 includes a top panel 36, a front panel 38, a back panel 40, a first side panel 42, and a second side panel 44. The door 28 contacts the first side panel 42, the second side panel 44, and the front panel 38 when the door 28 is in the closed position. The door 28 is spaced apart from the first side panel 42, the second side panel 44, and the front panel 38 when the door 28 is in the opened position as shown in FIG. 5. The enclosure 20 may further include a bottom panel 46. The door 28 is coupled to the bottom panel 46 by a hinge 48 that provides the door pivot axis 28A between the door 28 and the bottom panel 46. The door pivot axis 28A is spaced apart from the back panel 40 such that when the door 28 is in the closed position electrical wires of the lamp 16 are located above the bottom panel 46. In this way, the arrangement of the door pivot axis relative to the back panel 40 provides clearance for the electrical wires or portions of the lamp 16 within the housing 26 so that the door 28 can return to the closed position. In some embodiments, the bottom panel 46 may be omitted and the door 28 may be coupled to the back panel 40.

The housing 26 of the enclosure 20 may further include a corner panel 50 that extends between and interconnects the top panel 36 and the front panel 38 as shown in FIGS. 2 and 3. The corner panel 50 is arranged at an angle relative to both the top panel 36 and the front panel 38 such that the corner panel 50 lies along a plane different than both the top panel 36 and the front panel 38. The corner panel 50 is provided so that the enclosure 20 can fit within a small space such as eave 18. The corner panel 50 corresponds with an inside surface of a roof 52 of the building 12 so that the light fixture 10 can be positioned within eave 18. The angle of the corner panel 50 relative to the top panel 36 and the front panel 38 may be adjusted to match any roof inclination. The corner panel 50 may not be needed for some buildings. In other embodiments, the enclosure 20 is shaped differently to match a different part of the building 12.

The housing 26 may be made from a metallic material or any other suitable material. The housing 26 may include a waterproof material or a waterproof coating. The housing 26 may further include insulation to block ingress or egress of heat and/or moisture into the building 12 when the door 28 is in the opened position.

The door 28 is configured to open and close an opening 55 in an exterior surface 54 of the building 12 as shown in FIGS. 2 and 3. The door 28 may be made from any suitable material such as a metal, wood, ceramic, polymer, brick, stone, etc. The door 28 itself may include a material that matches a material of the exterior surface 54 of the building 12, or the door 12 may include one or more outer layers that match a material of the exterior surface 54 of the building 12. In this way, the door 28 blends in with the exterior surface 54 when the door 28 is in the closed position. The material of the door or outer layer of the door may be different than the material of the exterior surface of the building so long as an appearance of the door or outer layer of the door is similar to an appearance of the exterior surface of the building.

The door includes a door panel 60 and an optional lamp mount flange 62 coupled to the door panel 60 as shown in FIG. 5. The door panel 60 closes the opening 55 through the exterior surface 54 when the door 28 is in the closed position. The lamp mount flange 62 is arranged to lie at an angle relative to the door panel 60. The lamp 16 is mounted to the lamp mount flange 60 so that it is positioned relative to the enclosure 20 for illumination of area 15 when the light fixture is in the extended configuration. The lamp mount flange 62 is formed to include a slot 64 through which the actuator 22 extends and one or more mount apertures 66 for attachment of lamp 16 and/or another device.

Figure 6:
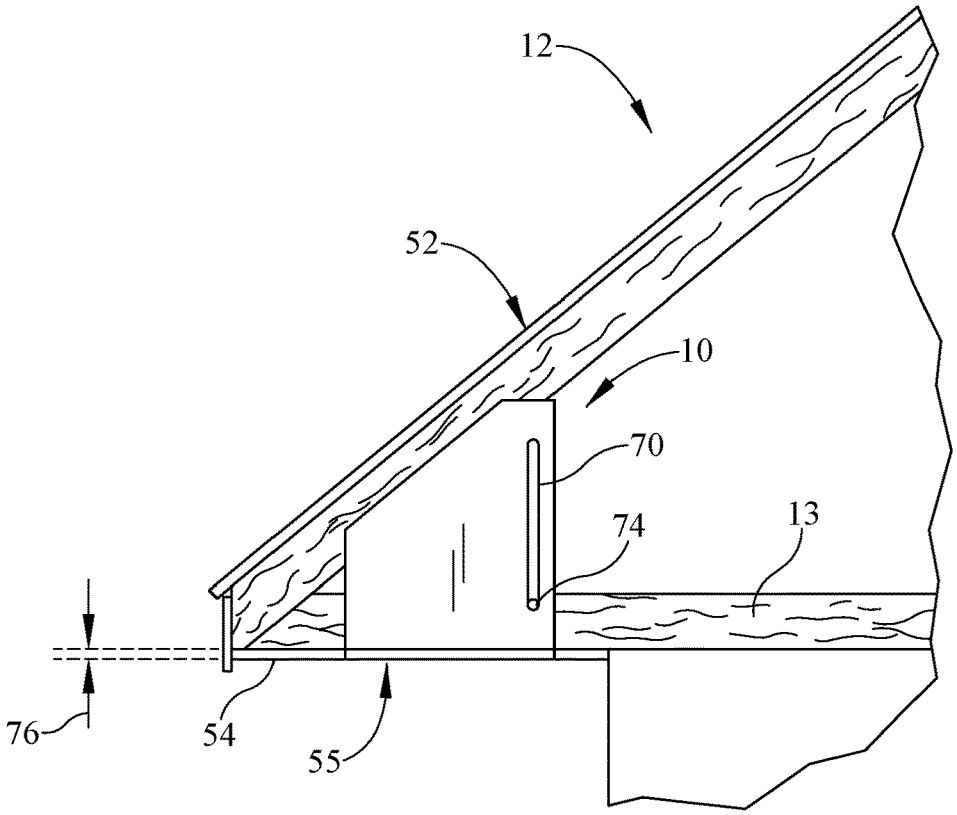
FIG. 6 is an elevation view showing the light fixture mounted to a ceiling joist and showing that the enclosure is formed to include a slot to allow the light fixture to be moved relative to the ceiling joist to position a door of the enclosure in line with an exterior wall of the building.
Figure 7:
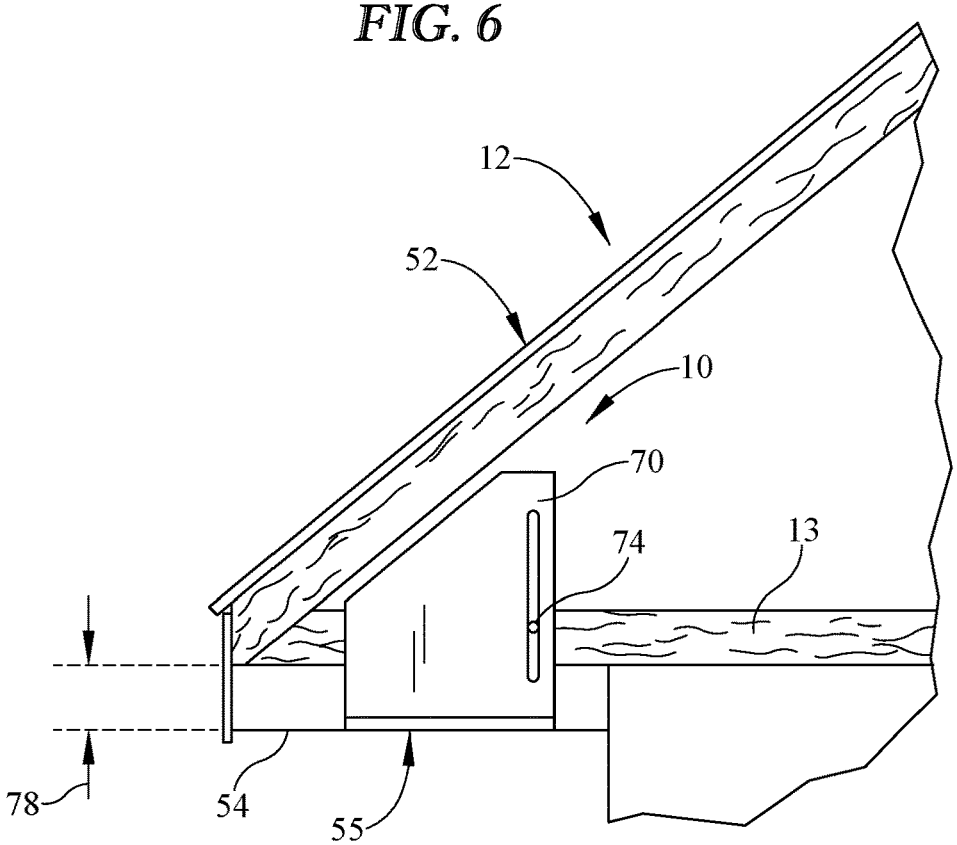
FIG. 7 is an elevation view similar to FIG. 6 showing another building with a greater distance between a ceiling joist and an exterior wall of the building compared to the building shown in FIG. 5 and showing the light fixture moved downwardly to position the door of the enclosure in line with the exterior wall of the building.
Figure 8:
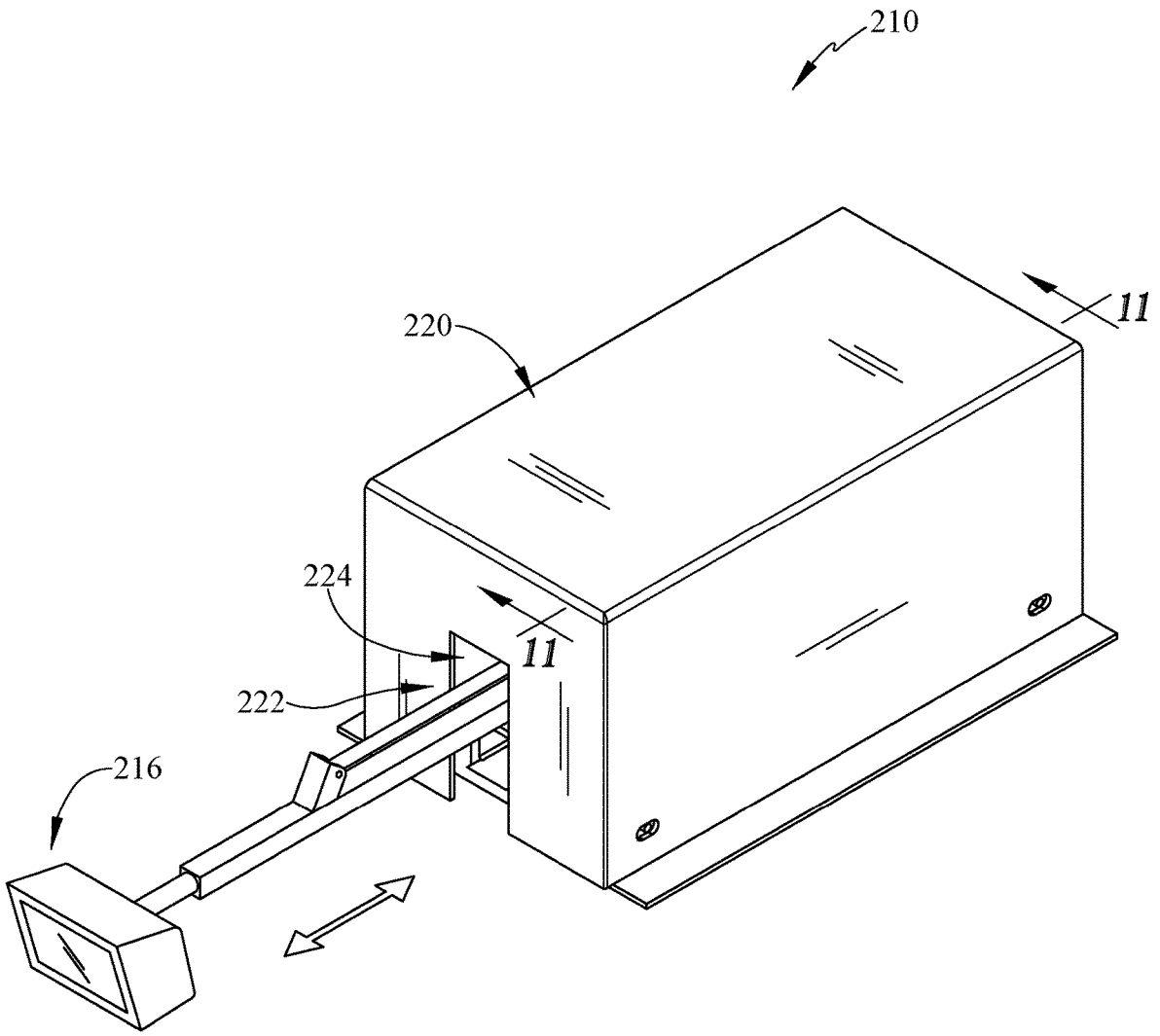
FIG. 8 is a perspective view of another embodiment of a light fixture having a retractable lamp in accordance with the present disclosure.

The light fixture 10 is configured to be mounted to the building such that the door 28 is flush with an exterior surface 54 of the building as shown in FIGS. 1-3. The housing 26 of the enclosure 20 is formed to include a pair of slots 70, 72 as shown in FIGS. 5, 6, and 7. The housing 26 of the enclosure 20 is coupled to a structure of the building 12 using one or more fasteners 74 that extend through a respective slot 70, 72. The slots 70, 72 are illustratively formed into first and second side panels 42, 44, but the slots may be formed into other panels of the housing 26.

The enclosure 20 may be moved relative to the building 12 such that the fastener(s) 74 are movable through each respective slot 70, 72 to adjust a position of the enclosure 20 relative to the building 12 as shown in FIGS. 6 and 7. For example, if an exterior wall of the building 12 is made from a material (i.e. wood) having a first thickness 76, then the enclosure 20 may be positioned such that the door 28 is flush with the exterior surface 54 of the exterior wall as shown in FIG. 6. If the exterior wall of the building 12 is made from a material (i.e. brick) having a second thickness 78 greater than first thickness 76, then the enclosure 20 may be adjusted downwardly such that the door 28 is flush with the exterior surface 54 of the exterior wall as shown in FIG. 7.

Another embodiment of a light fixture 210 having a retractable lamp 216 is shown in FIGS. 8-11. The light fixture 210 is similar to light fixture 10 described above. Similar reference numbers in the 200 series are used in relation to light fixture 210 to refer to similar features between light fixture 210 and light fixture 10. Accordingly, the disclosure above related to light fixture 10 is incorporated by reference herein for light fixture 210 except for differences between light fixture 10 and light fixture 210 explicitly described below.

The light fixture 210 includes an enclosure 220, an actuator 222, and a retractable lamp 216 that is configured to be moved by the actuator 222 between the retracted configuration and the extended configuration. The enclosure 220 defines an interior space 224 that houses and protects the actuator 222. The actuator 222 is configured to move in response to a user input to cause the lamp 216 extend and retract. The lamp 216 is hidden from view from an area 215 around a building 212 in the retracted configuration and is configured to illuminate the area 215 around the building 212 in the extended configuration.

Figure 9:
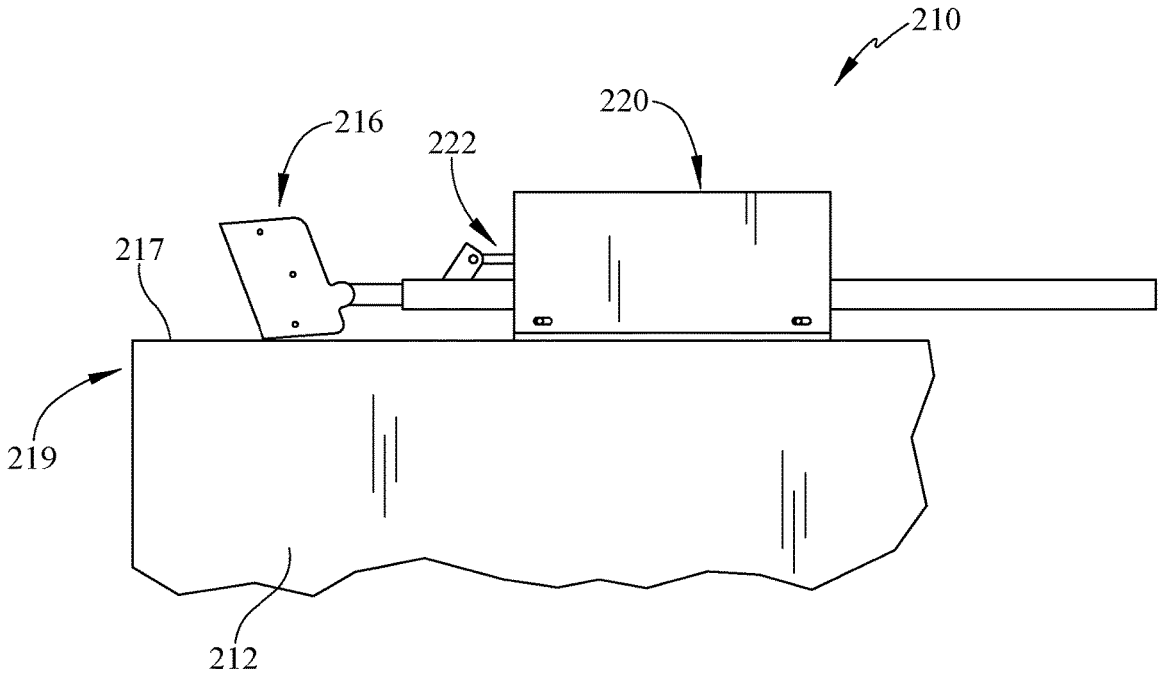
FIG. 9 is a side elevation view of the light fixture from FIG. 8 mounted on a roof of a building in a retracted configuration in which the retractable lamp is arranged behind a side wall of the building and hidden from view.
Figure 10:
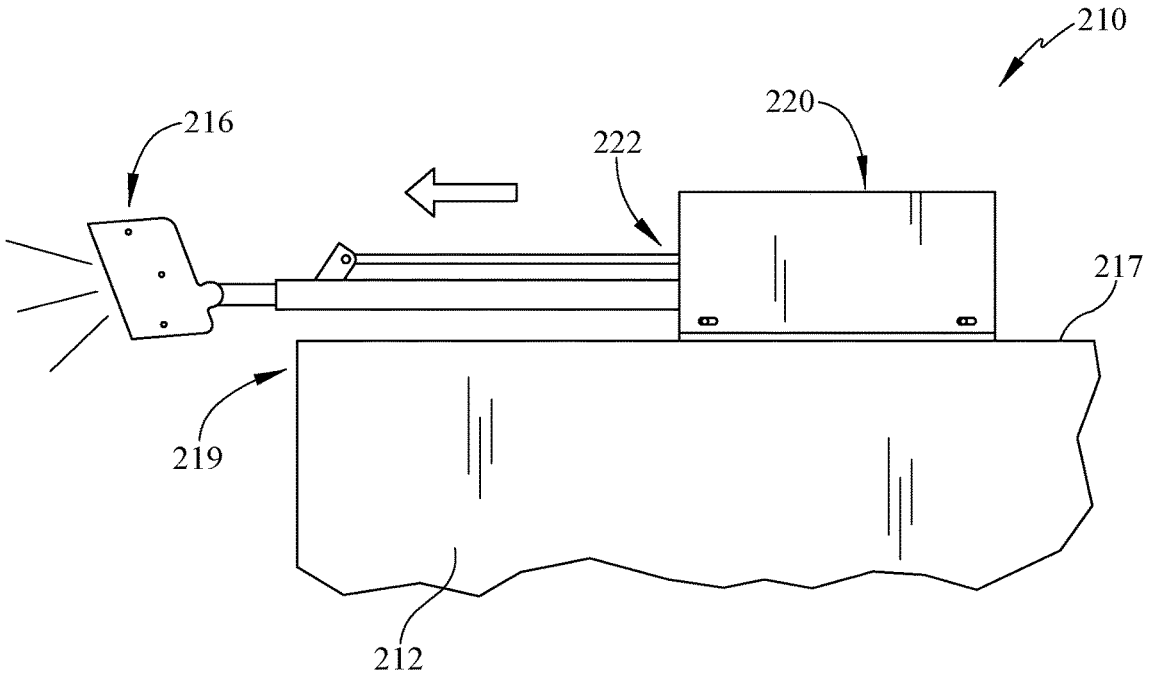
FIG. 10 is a side elevation view similar to FIG. 9 showing the light fixture in an extended configuration in which the lamp extends past the side wall of the building to illuminate an area around the building.

The enclosure 220 is configured to be mounted to a roof 217 of the building 212 to position the lamp 216 relative to the building 212 as shown in FIGS. 9 and 10. The roof 217 is flat in the illustrative embodiment, but the light fixture 210 may be mounted to other types of roofs or other structures of the building 212. When the light fixture 210 is in the retracted configuration, the lamp 216 is located directly above the roof 217 of the building 212 as shown in FIG. 9. When the light fixture 210 is in the extended configuration, the lamp 216 protrudes outwardly over an edge 219 of the building 212 so that the lamp 216 can illuminate the area 215 around the building 212 as shown in FIG. 10.

The actuator 222 is a linear actuator and is configured to translate the lamp 216 between the extended configuration and the retracted configuration as shown in FIGS. 9 and 10. The lamp 216 is an outdoor light, such as a flood light, in the illustrative embodiment. In some embodiments, another device such as a security camera may be used in place of or in addition to the lamp 216. It should be appreciated that the light fixture 210 may also be used in an interior setting with an indoor lamp 216.

Figure 11:
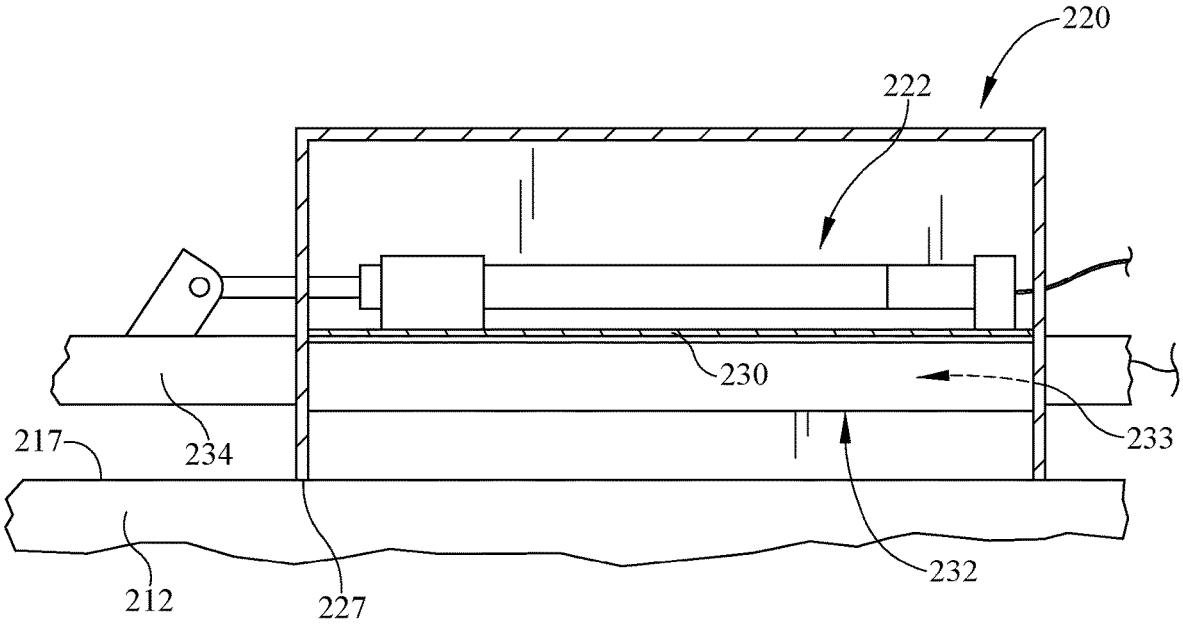
FIG. 11 is a sectional view taken along line 11-11 in FIG. 8 showing that the light fixture further includes an actuator arranged to lie within an enclosure of the light fixture.

The enclosure 220 includes a housing 226 that defines an interior space 224 and an actuator mount 228 arranged within the interior space 224 as shown in FIG. 11. the housing 226 is configured to protect the actuator 222 from rain, snow, ice, direct sunlight, etc. The actuator mount 228 is configured to position the actuator 222 above a lowermost edge 227 of the housing 226 and the roof 217 so that the actuator 222 is spaced from any water that may run under the lowermost edge 227 of the housing 226 and into the interior space 224.

The actuator mount 228 includes a support panel 230 coupled to the actuator and a hollow crossbeam 232 arranged to lie beneath the support panel and the actuator as shown in FIG. 11. The support panel 230 is configured to support the actuator 222 above the lowermost edge 227 of the housing 226 and the roof 217. The hollow crossbeam 232 defines an internal passageway 233 that receives a support rod 234 of the lamp 216. The support rod 234 is translated through the hollow crossbeam 232 by the actuator 222 to change the light fixture 210 between the extended configuration and the retracted configuration. Electrical wires of the lamp 216 also extend through the hollow crossbeam 232 to guide the electrical wires as the lamp 216 changes between extended and retracted positions. In some embodiments, the hollow crossbeam 232 is omitted. In some embodiments, the support panel 230 is omitted and the actuator 222 is coupled to the hollow crossbeam 232.

The invention claimed is:

1. A light fixture comprising:

a light fixture housing adapted to secure the light fixture to a building and defining an interior space, wherein the light fixture housing includes an enclosure that defines the interior space and an actuator mount arranged to lie within the interior space and configured to position the actuator above a lowermost edge of the enclosure, a lamp configured to move between a hidden position and an exposed position, and an actuator coupled to the light fixture housing and the lamp and configured to move the lamp between the hidden position, in which the lamp is obstructed from view from an area, and the exposed position, in which the lamp is visible from the area and is configured to illuminate the area, wherein the actuator mount includes a support panel coupled to the actuator, and a hollow crossbeam coupled to the support panel below the actuator, and wherein electrical wires of the lamp extend through the hollow crossbeam to guide the electrical wires as the lamp changes between the hidden position and the exposed position.

2. The light fixture of claim 1, wherein the actuator is arranged to lie in the interior space of the light fixture housing when the lamp is in the hidden position.

3. The light fixture of claim 2, wherein the actuator mount is configured to position the actuator above a lowermost edge the housing and a roof.

4. The light fixture of claim 3, is spaced from any water that may run under the lowermost edge of the housing and the roof.

5. The light fixture of claim 3, further comprising a camera.

6. The light fixture of claim 2, wherein the light fixture is configured for outdoor use.

7. The light fixture of claim 6, further comprising a camera.

8. The light fixture of claim 2, wherein the light fixture is configured for indoor use.

9. The light fixture of claim 8, further comprising a camera.

10. The light fixture of claim 2, further comprising a camera.

11. The light fixture of claim 2, is spaced from any water that may run under the lowermost edge of the housing.

12. The light fixture of claim 1, further comprising a camera.

13. The light fixture of claim 1, wherein the actuator mount is configured to position the actuator above a lowermost edge the housing and a roof.

14. The light fixture of claim 13, is spaced from any water that may run under the lowermost edge of the housing and the roof.

15. The light fixture of claim 1, wherein the light fixture is configured for outdoor use.

16. The light fixture of claim 15, further comprising a camera.

17. The light fixture of claim 1, wherein the light fixture is configured for indoor use.

18. The light fixture of claim 17, further comprising a camera.

19. The light fixture of claim 1, further comprising a camera.

20. The light fixture of claim 1, is spaced from any water that may run under the lowermost edge of the housing.

* * * * *